US011017753B2

(12) United States Patent
Ichiki

(10) Patent No.: US 11,017,753 B2
(45) Date of Patent: May 25, 2021

(54) KEYBOARD DEVICE

(71) Applicant: YAMAHA CORPORATION, Hamamatsu (JP)

(72) Inventor: Shunsuke Ichiki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 89 days.

(21) Appl. No.: 16/570,002

(22) Filed: Sep. 13, 2019

(65) Prior Publication Data

US 2020/0005749 A1 Jan. 2, 2020

Related U.S. Application Data

(63) Continuation of application No. PCT/JP2018/010606, filed on Mar. 16, 2018.

(30) Foreign Application Priority Data

Mar. 16, 2017 (JP) ..... JP2017-050897

(51) Int. Cl.
*G10H 1/34* (2006.01)
*G10C 3/12* (2006.01)

(52) U.S. Cl.
CPC ..... *G10H 1/344* (2013.01); *G10C 3/12* (2013.01); *G10H 2220/221* (2013.01); *G10H 2220/275* (2013.01)

(58) Field of Classification Search
CPC ..... G10H 1/344; G10H 2220/221; G10H 2220/275; G10C 3/12
See application file for complete search history.

(56) References Cited

U.S. PATENT DOCUMENTS 2,117,002 A * 5/1938 Hammond ..... G10C 3/12 84/423 R
3,095,465 A * 6/1963 Holman ..... G10H 1/344 84/433

(Continued)

FOREIGN PATENT DOCUMENTS

JP 3846426 B2 11/2006
JP 2009236943 A 10/2009
JP 2009236946 A 10/2009

OTHER PUBLICATIONS

International Search Report issued in Intl. Appln No. PCT/JP2018/010606 dated May 29, 2018. English translation provided.

(Continued)

*Primary Examiner* — Robert W Horn
(74) *Attorney, Agent, or Firm* — Rossi, Kimms & McDowell LLP

(57) ABSTRACT

A keyboard device includes: a frame; a plurality of keys including a first key and a second key, the plurality of keys rotating around the frame; and a plurality of guides for restricting an operation of each of the plurality of keys, at positions different in a vertical direction, each of the plurality of guides including a first member that is softer than the frame and the plurality of keys, and a second member that is harder than the first member, wherein each of the plurality of guides is in a first state where a corresponding one of the keys comes into contact with the first member, or in a second state where the corresponding one of the keys comes into contact with the second member.

15 Claims, 14 Drawing Sheets

(56) References Cited

U.S. PATENT DOCUMENTS 3,532,003 A * 10/1970 Ohno ..... G10H 1/344 74/108
4,272,657 A * 6/1981 Iijima ..... H01H 13/702 200/5 A
4,365,536 A * 12/1982 Koepke ..... G10C 3/12 84/433
4,512,234 A * 4/1985 Kumano ..... G10H 1/344 84/433
4,604,937 A * 8/1986 Kumano ..... G10H 1/344 84/434
4,633,753 A * 1/1987 Takahashi ..... G10C 3/18 84/220
5,070,218 A * 12/1991 Katsuta ..... H01H 21/22 200/5 A
5,079,985 A * 1/1992 Yamaguchi ..... G10C 3/12 84/719
5,107,748 A * 4/1992 Muramatsu ..... G10H 1/0555 341/27
5,249,497 A * 10/1993 Niitsuma ..... G10C 3/12 84/247
5,386,083 A * 1/1995 Kawamura ..... G10H 1/346 84/719
5,495,074 A * 2/1996 Kondo ..... G10H 1/344 84/690
5,542,332 A * 8/1996 Tamai ..... G10H 1/344 84/251
5,578,782 A * 11/1996 Masubuchi ..... G10H 1/0556 84/687
5,610,352 A * 3/1997 Yamaguchi ..... G10C 3/12 84/251
5,719,347 A * 2/1998 Masubuchi ..... G10H 1/344 84/687
5,763,799 A * 6/1998 Kimble ..... G10C 3/12 84/433
5,844,154 A * 12/1998 Kimble ..... G10C 3/161 84/171
5,894,099 A * 4/1999 Niitsuma ..... G10C 3/12 84/430
6,005,178 A * 12/1999 Osuga ..... G10H 1/346 84/423 R
6,191,351 B1 * 2/2001 Niitsuma ..... G10H 1/346 84/423 R
6,653,542 B2 * 11/2003 Suzuki ..... G10C 3/12 84/423 R
7,514,613 B2 * 4/2009 Yamaguchi ..... G10C 3/12 84/236
7,541,532 B2 * 6/2009 Osuga ..... G10C 3/12 84/423 R
7,550,659 B2 * 6/2009 Shimoda ..... G10C 3/12 84/251
7,683,248 B2 * 3/2010 Rawson ..... G10C 3/12 84/423 R
8,148,620 B2 * 4/2012 Jones ..... G10C 5/10 84/423 R
10,762,884 B2 * 9/2020 Suzuki ..... G10H 1/346
2011/0239846 A1 * 10/2011 Shimoda ..... G10H 1/344 84/687

OTHER PUBLICATIONS

Written Opinion issued in Intl. Appln. No. PCT/JP2018/010606 dated May 29, 2018.

* cited by examiner (A)

(B)

KEYBOARD DEVICE

TECHNICAL FIELD

The present invention relates to a keyboard device.

BACKGROUND ART

A keyboard device is provided with a plurality of keys that are arranged in a line. Arrangement accuracy of the plurality of keys significantly affects the appearance of a musical instrument. For this reason, if the shape of a key is deformed due to a manufacturing error, this deformation will directly degrade the appearance the musical instrument. Technology has been developed that is related to key guides that are connected to a frame for adjusting the position of keys in the case where a manufacturing error has occurred (for example, Patent Document 1). Of these guides, guides that are arranged at positions particularly close to a player not only adjust the arrangement of the plurality of keys but also affect the sense (hereinafter, "touch") that the player feels on his fingers while playing the keyboard.

Patent Literature 1: JP 3846426B

SUMMARY OF INVENTION

In the case where the aforementioned guides are configured by portions of the keys and the frame, a configuration in which a soft sliding member is provided between each key and the frame is employed to suppress mechanical noise that is generated by a guide when a key is pressed and/or released. However, if the sliding member is provided between each key and the frame, the rigidity of the key in the rolling direction deteriorates. The degree to which the decrease in the rigidity of a key in the rolling direction affects the player differs depending on the key. That is, the touch will differ depending on the key.

An object of the present invention is to make the touch of each key adjustable.

A first keyboard device according to the present invention includes: a frame; a plurality of keys including a first key and a second key, the plurality of keys rotating around the frame; and a plurality of guides for restricting an operation of each of the plurality of keys, at positions different in a vertical direction, each of the plurality of guides including a first member that is softer than the frame and the plurality of keys, and a second member that is harder than the first member, wherein each of the plurality of guides is in a first state where a corresponding one of the keys comes into contact with the first member, or in a second state where the corresponding one of the keys comes into contact with the second member, and the number of guides restricting the second key in the second state is greater than the number of guides restricting the first key in the second state.

The first key may be a white key, and the second key may be a black key.

A member to which the first member that comes into contact with the white key is attached and the second member that comes into contact with the white key may be the same member.

A member to which the first member that comes into contact with the black key is attached and the second member that comes into contact with the black key may be the same member.

The first member that comes into contact with the white key may be attached to the frame.

The first member that comes into contact with the black key may be attached to the frame.

The second member that comes into contact with the white key may be a portion of the frame.

The second member that comes into contact with the black key may be a portion of the frame.

The first member that comes into contact with the white key may be attached to the white key.

The first member that comes into contact with the black key may be attached to the black key.

Of the plurality of guides that come into contact with the white key, an upper one of the guides may be in the first state.

Of the plurality of guides that come into contact with the black key, an upper one of the guides may be in the first state.

A second keyboard device according to the present invention includes: a frame; a plurality of keys including a first key and a second key, the plurality of keys rotating around the frame; and a plurality of guides arranged between each of the plurality of keys and the frame at positions different in a vertical direction, each of the plurality of guides including a first member that is softer than the frame and the plurality of keys, and a second member that is harder than the first member, wherein the first member is sandwiched by the frame and a corresponding one of the keys, the second member is sandwiched by the frame and a corresponding one of the keys, each of the plurality of guides is in a first state where a corresponding one of the keys comes into contact with the first member, or in a second state where the corresponding one of the keys comes into contact with the second member, and the number of guides that come into contact with the second key in the second state is greater than the number of guides that come into contact the first key in the second state.

A third keyboard device according to the present invention includes: a frame; a plurality of keys including a first key and a second key, the plurality of keys rotating around the frame; and a plurality of guides arranged between each of the plurality of keys and the frame at positions different in a vertical direction, each of the plurality of guides including a first member that is softer than the frame and the plurality of keys, wherein the first member is sandwiched by the frame and a corresponding one of the keys, each of the plurality of guides is in a first state where a corresponding one of the keys comes into contact with the first member, or in a second state where the corresponding one of the keys comes into contact with the frame, and the number of guides that come into contact with the second key in the second state is greater than the number of guides that come into contact the first key in the second state.

In the third keyboard device, the first key may be a white key, the second key may be a black key, guides for the black key may include at least one first member, and guides for the white key may include at least one first member.

According to the present invention, the touch of each key can be made adjustable.

DESCRIPTION OF EMBODIMENTS

Figure 1:
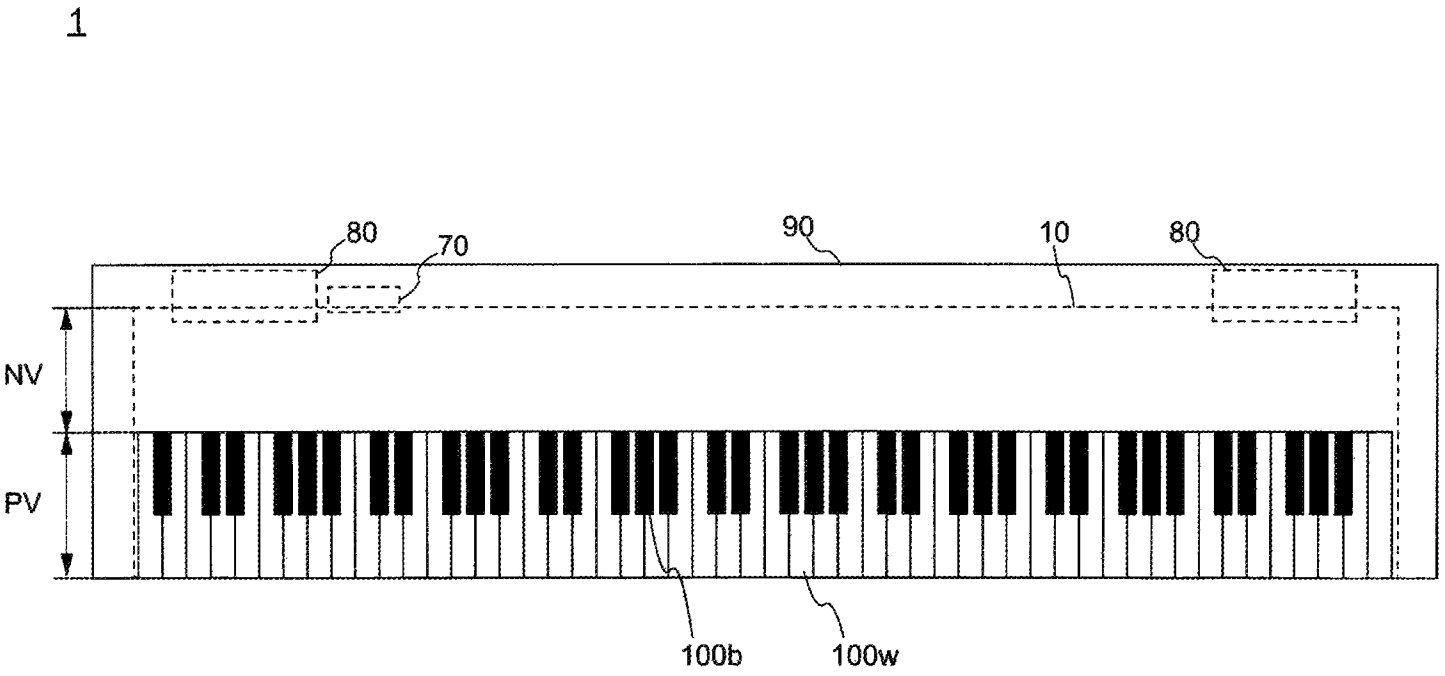
FIG. 1 shows the configuration of a keyboard device in an embodiment of the present invention.

Hereinafter, a keyboard device in one embodiment of the present invention will be described in detail with reference to the drawings. The embodiment disclosed below is an example of an embodiment of the present invention, and the present invention is not to be interpreted as limited by this embodiment. In the drawings referred to in the present embodiment, the same portions or portions having similar functions are denoted by the same reference numerals or similar reference numerals (reference numerals with only A, B, or the like appended after numerals), and repeated description of such portions may be omitted. Also, dimensional ratios (ratios between configurations, ratios between vertical and horizontal directions, or the like) in the drawings may differ from actual ratios for convenience of a description, and some configurations may be omitted from the drawings.

First Embodiment

Configuration of Keyboard Device

FIG. 1 shows the configuration of a keyboard device in an embodiment of the present invention. In this example, a keyboard device 1 is an electronic keyboard musical instrument such as an electronic piano that generates sound in accordance with a key being pressed by a user (a player). Note that the keyboard device 1 may also be a keyboard-type controller that outputs control data (for example, MIDI) for controlling an external sound source device in accordance with a key being pressed. In this case, the keyboard device 1 may not have a sound source device.

The keyboard device 1 includes a keyboard assembly 10. The keyboard assembly 10 includes white keys 100*w* and black keys 100*b*. A plurality of white keys 100*w* and black keys 100*b* are arranged side by side. The number of keys 100 is N, which is 88 in this example. The direction in which the plurality of white keys 100*w* and black keys 100*b* are arranged is referred to as a scale direction. When the white keys 100*w* and the black keys 100*b* can be described without particularly distinguishing them, they may be referred to as the keys 100. In the following description as well, when "w" is appended to the end of a reference numeral, this means that this configuration corresponds to a white key. When "b" is appended to the end of a reference numeral, this means that the configuration corresponds to a black key.

Directions (scale direction, rolling direction, yawing direction, and vertical direction) used in the following description will be defined. The scale direction corresponds to the direction in which the keys 100 are arranged (i.e. the left-right direction as seen from the player), as mentioned above. The rolling direction corresponds to the direction in which each key 100 rotates around an axis extending in the direction in which the keys 100 extend (i.e. the direction from the front side toward the rear side as seen from the player). The yawing direction is the direction in which each key 100 curves in the left-right direction when the keys 100 are seen from above. Although the scale direction does not significantly differ from the yawing direction, movement of a key 100 in the scaling direction means parallel movement, whereas movement of a key 100 in the yawing direction corresponds to curving (warping) in the scale direction. The vertical direction corresponds to the direction in which a rod-like flexible member 185 extends (i.e. the vertical direction as seen from the player), and can also be considered to be the direction acting as an axis of curving in the yawing direction.

Part of the keyboard assembly 10 exists inside a case 90. In other words, the case 90 covers part of the white keys 100*w* and the black keys 100*b*. When the keyboard device 1 is viewed from above, a portion of the keyboard assembly 10 covered by the case 90 is referred to as a non-visible area NV, and a portion exposed from the case 90 and visible to the user is referred to as a visible area PV. That is, it can also be said that the visible area PV is an area where the appearance of the keys 100 is visible, and is an area where the user can perform a musical performance playing operation. In other words, it can also be said that the visible area PV is an area on the key front end side of the visible portion of the black keys 100*b*. Note that, for example, guides provided on the key front end side of the white keys 100*w* and the black keys 100*b* are not visible to the user, but it can be said that these guides are within the visible area PV because of the positions at which the guides are present. Hereinafter, the portion of the keys 100 exposed by the visible area PV may also be referred to as a key main body.

A sound source device 70 and a speaker 80 are arranged inside of the case 90. The sound source device 70 generates a sound waveform signal according to pressing of a key 100. The speaker 80 outputs the sound waveform signal generated in the sound source device 70 to an external space. Note that the keyboard device 1 may also be provided with a slider for controlling volume, a switch for switching timbre, a display that displays various information, and the like.

Note that in the description of this specification, directions such as up, down, left, right, front and rear indicate directions when the keyboard device 1 is viewed from the player when playing. Therefore, for example, the non-visible area NV can be said to be located on the rear side relative to the visible area PV. Also, the direction may be indicated based on the keys 100, such as a key front end side (key front side) and a key rear end side (key rear side). In this case, the key front end side indicates the front side of a key 100 as viewed from the player. The key rear side indicates the rear side of a key 100 as viewed from the player. According to this definition, it can be said that a portion from the front end to the rear end of the key main body of a black key 100*b* is a portion protruding upward from the white keys 100*w*.

Figure 2:
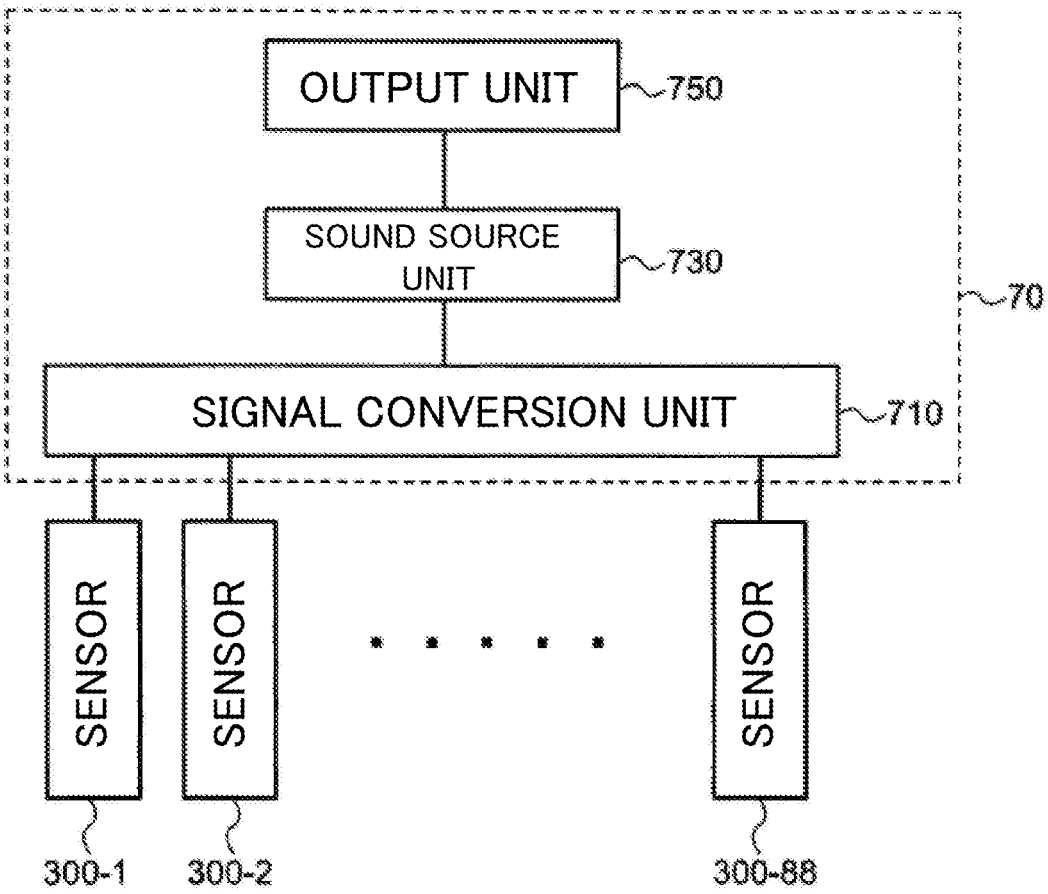
FIG. 2 is a block diagram that shows the configuration of a sound source device in an embodiment of the present invention.

FIG. 2 is a block diagram that shows the configuration of a sound source device in an embodiment of the present invention. The sound source device 70 includes a signal conversion unit 710, a sound source unit 730, and an output unit 750. A sensor 300 is provided corresponding to each key 100, detects operation of the corresponding key, and outputs a signal according to the detected content. In this example, the sensor 300 outputs a signal according to a three step key pressing amount. A key pressing speed can be detected according to an interval of this signal.

The signal conversion unit 710 obtains an output signal of the sensors 300 (sensors 300-1, 300-2, . . . , 300-88 corresponding to the 88 keys 100), generates an operation signal according to the operation state of each key 100, and outputs the operation signals. In this example, the operation signal is a signal in MIDI format. Therefore, according to the key pressing operation, the signal conversion unit 710 outputs a note-on signal. At this time, a key number indicating which of the 88 keys 100 was operated, and a velocity corresponding to the key pressing speed, are also output associated with the note-on signal. On the other hand, according to a key release operation, the signal conversion unit 710 outputs the key number and a note off signal associated with each other. A signal corresponding to another operation such as operation of a pedal may also be input to the signal conversion unit 710, and reflected in an operation signal.

The sound source unit 730 generates a sound waveform signal based on the operation signal output from the signal conversion unit 710. The output unit 750 outputs the sound waveform signal generated by the sound source unit 730. The sound waveform signal is output to the speaker 80 or a sound waveform signal output terminal, for example.

Configuration of Keyboard Assembly

Figure 3:
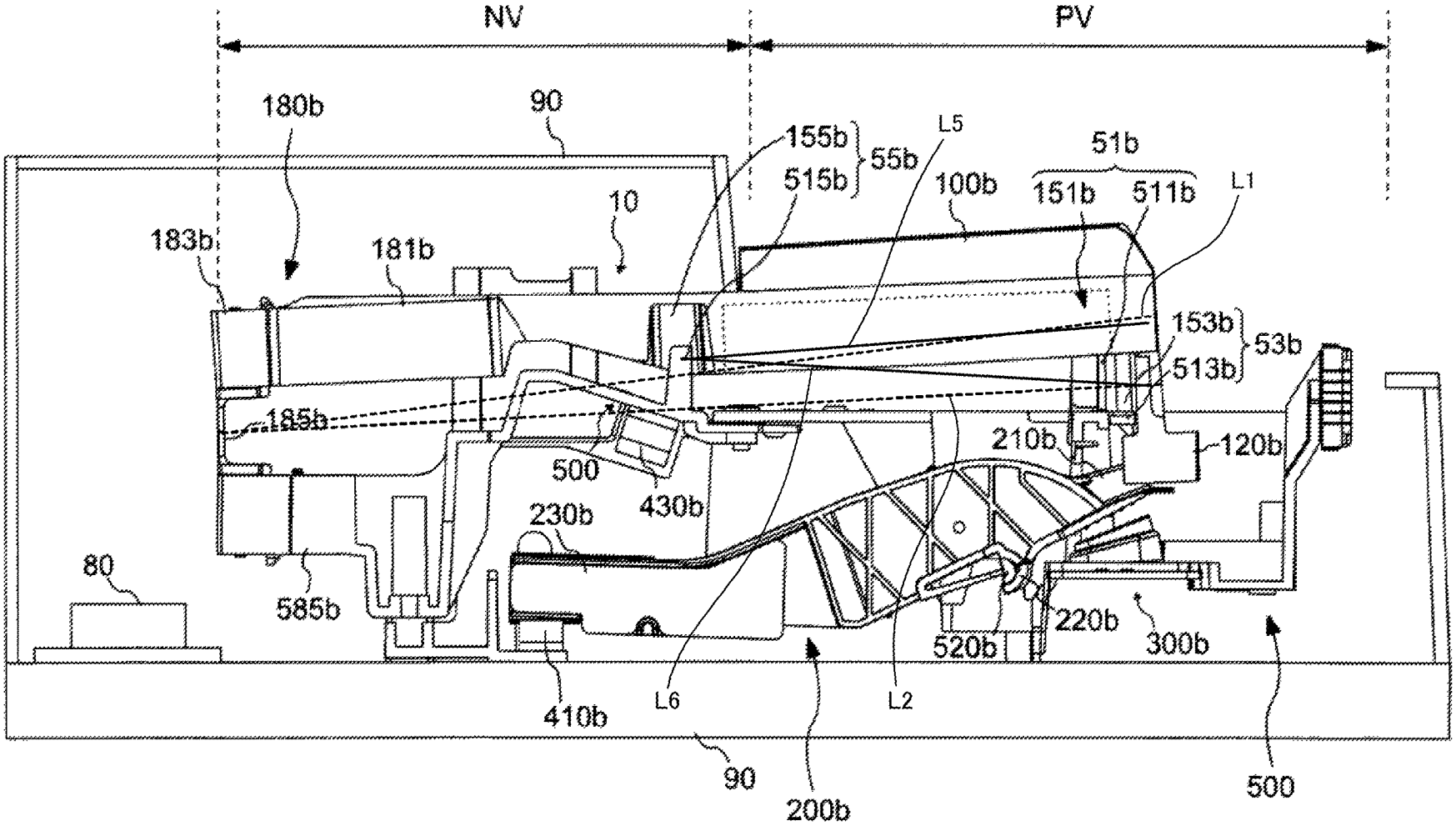
FIG. 3 is a diagram illustrating a black key when the configuration inside a case in an embodiment of the present invention is viewed from the side.

FIG. 3 is a diagram illustrating a black key when the configuration inside the case in an embodiment of the present invention is viewed from the side. FIG. 3 illustrates a structure of the keyboard assembly 10, using a black key 100*b*. As shown in FIG. 3, the keyboard assembly 10 and the speaker 80 are arranged inside the case 90. The speaker 80 is disposed on the rear side of the keyboard assembly 10. The speaker 80 is arranged so as to output a sound, which corresponds to a key being pressed, toward the upper and lower sides of the case 90. The sound that is output downward travels from the lower face side of the case 90 to the outside. On the other hand, the sound that is output upward passes through a space within the keyboard assembly 10 from the inside of the case 90, and travels to the outside from gaps between adjacent black keys 100*b* in the visible area PV or gaps between the black keys 100*b* and the case 90.

The keyboard assembly 10 includes the connecting portion 180*b*, a hammer assembly 200*b*, and the frame 500 in addition to the black key 100*b* described above. The frame 500 is fixed to the case 90. The connecting portion 180*b* rotatably connects the black key 100*b* to the frame 500. The connecting portion 180*b* includes a plate-like flexible member 181*b*, a key side support portion 183*b*, and a rod-like flexible member 185*b*. The plate-like flexible member 181*b* extends from the rear end of the keys 100 toward the key rear end side. The key side support portion 183*b* extends rearward from the rear end of the plate-like flexible member 181*b*. The rod-like flexible member 185*b* is supported by the key side support portion 183*b* and a frame side support portion 585*b* of the frame 500. That is, the rod-like flexible member 185*b* is arranged between the black key 100*b* and the frame 500. Due to the bending of the rod-like flexible member 185*b*, the black key 100*b* can rotate relative to the frame 500. The rod-like flexible member 185*b* is configured to be removable from the key side support portion 183*b* and the frame side support portion 585*b*. The keyboard assembly 10 is a structure that is made of a resin and with which most of the constituent components thereof are manufactured by means of, for example, injection molding. Note that the rod-like flexible member 185*b* may be configured so as to not be removable, by being formed as a single body with the key side support portion 183*b* and the frame side support portion 585*b*, or by adhesion or the like.

The black key 100*b* is provided with a first guide 51*b*, a second guide 53*b*, and a third guide 55*b*. The first guide 51*b* and the second guide 53*b* are provided on the front end side of the black key 100*b* in the visible area PV, and restrict operation of the black key 100*b* at positions different in the vertical direction. The third guide 55*b* is provided in the non-visible area NV, and restricts operation of the black key 100*b*. The first guide 51*b* includes a first key guide 151*b* and a first frame guide 511*b*. The second guide 53*b* includes a second key guide 153*b* and a second frame guide 513*b*. The third guide 55*b* includes a side face key guide 155*b* and a side face frame guide 515*b*. The first key guide 151*b*, the second key guide 153*b*, and the side face key guide 155*b* are connected to the black key 100*b*. The first frame guide 511*b*, the second frame guide 513*b*, and the side face frame guide 515*b* are connected to the frame 500.

The first key guide 151*b* slides with respect to the first frame guide 511*b*. The second key guide 153*b* slides with the second frame guide 513*b*. The side face key guide 155*b* slides with respect to the side face frame guide 515*b*. The first guide 51*b*, the second guide 53*b*, and the third guide 55*b* are guides that restrict the position of the black key 100*b* in the scale direction and the operating direction of the black key 100*b* when the key is pressed and/or released. The side face key guide 155*b* is in slidable contact with the side face frame guide 515*b*, in a state of being sandwiched thereby. In other words, the side face key guide 155*b* is in slidable contact with the side face frame guide 515*b*, which extends upward from the frame 500, from both sides thereof in the scale direction. Note that the detailed structure of the first guide 51*b* and the second guide 53*b* will be described later.

The aforementioned three guides 51*b* to 55*b* are not arranged on the same line when the key 100 is viewed in the scale direction. More specifically, as shown in FIG. 3, the second guide 53 is not located on a line L5 that substantially connects the third guide 55*b* to the first guide 51*b*, and the first guide 51 is not located on a line L6 that substantially connects the third guide 55*b* to the second guide 53*b*. With the guides that are thus arranged at at least three portions, movement of the key 100 in the scale direction, the yawing direction, and the rolling direction can be restricted. Note that the third guide for restricting movement of the key 100 in the scale direction may be provided at another direction, and may be provided at the same position as the position of a later-described key fulcrum. Although FIG. 4 does not show the lines L5 and L6, guides for a white key are also in a similar positional relationship.

Although FIG. 3 shows, as an example, a configuration in which the third guide 55*b* is arranged in the non-visible area NV, the configuration of the third guide 55*b* is not limited this configuration. For example, the third guide 55*b* may alternatively be arranged in an area that corresponds to the visible area PV.

The hammer assembly 200*b* is rotatably attached to the frame 500. Here, a shaft support portion 220*b* of the hammer assembly 200*b* is in slidable contact with a rotational shaft 520*b* of the frame 500 at at least three points. A front end portion 210*b* of the hammer assembly 200*b* is in slidable contact with a hammer support portion 120*b* substantially in the front-rear direction within an internal space thereof. This sliding portion, that is, the portion at which the front end portion 210*b* is in contact with the hammer support portion 120*b* is located below the black key 100*b* in the visible area PV.

The hammer assembly 200*b* is provided with a weight portion 230*b*, which is made of metal, on the rear side of the rotational shaft 520*b*. In a normal state (when the key is not pressed), the weight portion 230*b* is in a state of being placed on a lower side stopper 410*b*, and the front end portion 210*b* of the hammer assembly 200*b* presses back the black key 100*b* upward. When the key is pressed, the weight portion 230*b* moves upward and collides with an upper side stopper 430*b*. The hammer assembly 200*b* applies a weight to the pressed key using the weight portion 230*b*. The lower side stopper 410*b* and the upper side stopper 430*b* are formed with a buffer material or the like (non-woven fabric, an elastic body, or the like).

A sensor 300*b* is attached to a portion of the frame 500 below the hammer support portion 120*b* and the front end portion 210*b*. If the sensor 300*b* is pressed by a lower face side of the front end portion 210*b* as a result of the key being pressing, the sensor 300*b* outputs a detection signal. The sensor 300*b* is provided corresponding to each of the keys 100, as mentioned above.

Figure 4:
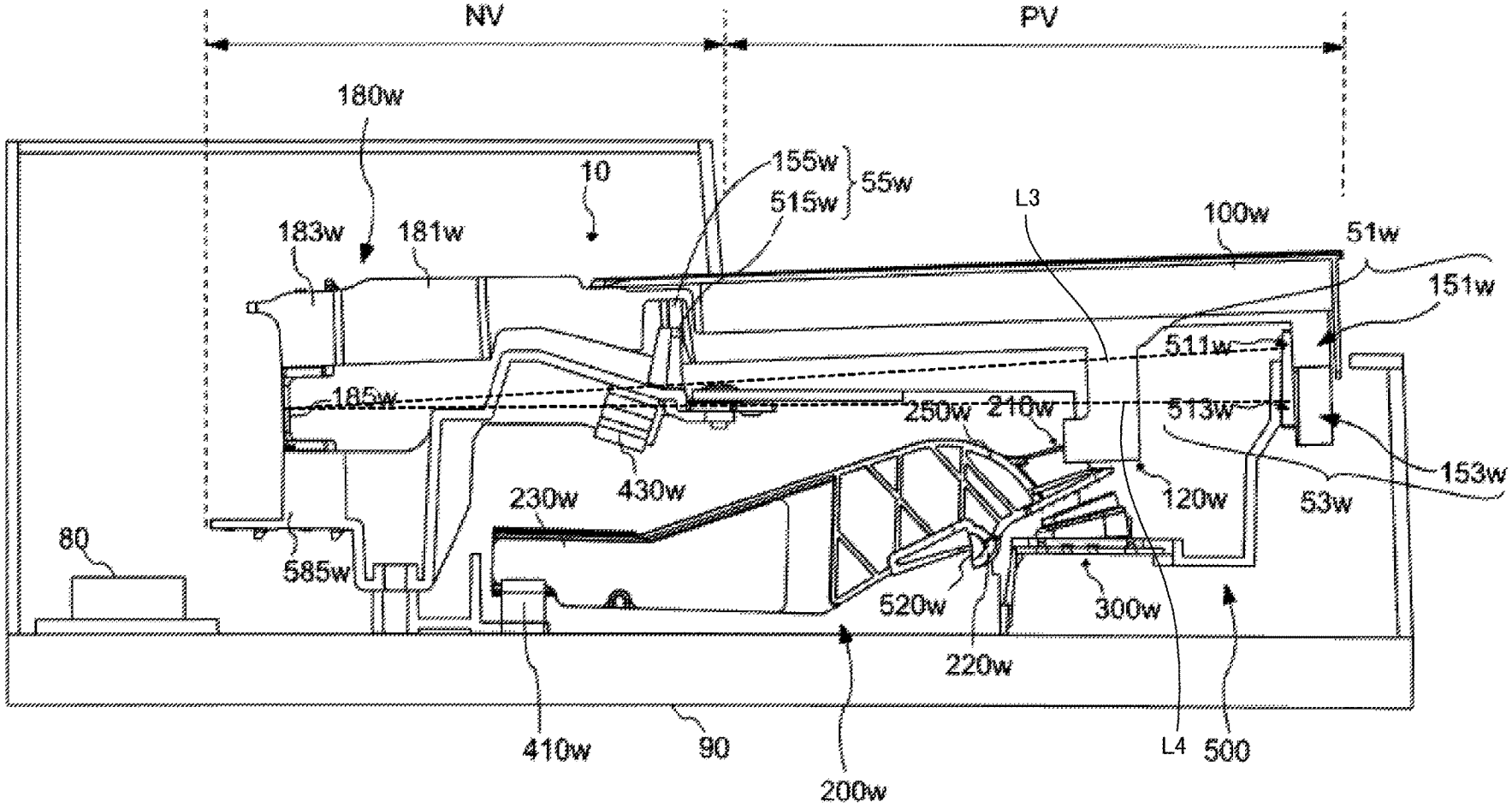
FIG. 4 is a diagram illustrating a white key when the configuration inside the case in an embodiment of the present invention is viewed from the side.

FIG. 4 is a diagram illustrating a white key when the configuration inside the case in an embodiment of the present invention is viewed from the side. FIG. 4 illustrates a structure of the keyboard assembly 10 using a white key 100*w*. In the following description, of the structure of the keyboard assembly 10 of a white key 100*w*, features similar to those of the structure of the keyboard assembly 10 of the black key 100*b* shown in FIG. 3 may not be described.

The white key 100*w* is provided with a first guide 51*w*, a second guide 53*w*, and a third guide 55*w*. The first guide 51*w* and the second guide 53*w* are provided on the front end side of the white key 100*w* in the visible area PV, and restrict operation of the white key 100*w* at positions different in the vertical direction. Although the details will be described later, in this embodiment, the first guide 51*w* and the second guide 53*w* are constituted by the same member, but restrict operation of the white key 100*w* at different positions. The first guide 51*w* restricts operation of the white key 100*w* above the second guide 53*w*. The third guide 55*w* is provided in the non-visible area NV, and restricts operation of the white key 100*w*. The first guide 51*w* includes a first key guide 151*w* and a first frame guide 511*w*. The second guide 53*w* includes a second key guide 153*w* and a second frame guide 513*w*. The third guide 55*w* includes a side face key guide 155*w* and a side face frame guide 515*w*. The first key guide 151*w*, the second key guide 153*w*, and the side face key guide 155*w* are connected to the white key 100*w*. The first frame guide 511*w*, the second frame guide 513*w*, and the side face frame guide 515*w* are connected to the frame 500.

The first key guide 151*w* slides with respect to the first frame guide 511*w*. The second key guide 153*w* slides with respect to the second frame guide 513*w*. The side face key guide 155*w* slides with respect to the side face frame guide 515*w*. The first guide 51*w*, the second guide 53*w*, and the third guide 55*w* are guides that restrict the position of the white key 100*w* in the scale direction and the operating direction of the white key 100*w* when the key is pressed and/or released. The side face key guide 155*w* is in slidable contact with the side face frame guide 515*w*, in a state of being sandwiched thereby. In other words, the side face key guide 155*w* is in slidable contact with the side face frame guide 515*w*, which extends upward from the frame 500, from both sides thereof in the scale direction. Note that the detailed structure of the first guide 51*w* and the second guide 53*w* will be described later.

Although FIG. 4 shows, as an example, a configuration in which the third guide 55*w* is arranged in the non-visible area NV, the configuration of the third guide 55*w* is not limited to this configuration. For example, the third guide 55*w* may alternatively be arranged in an area that corresponds to the visible area PV.

Structure of Key

Figure 5A:
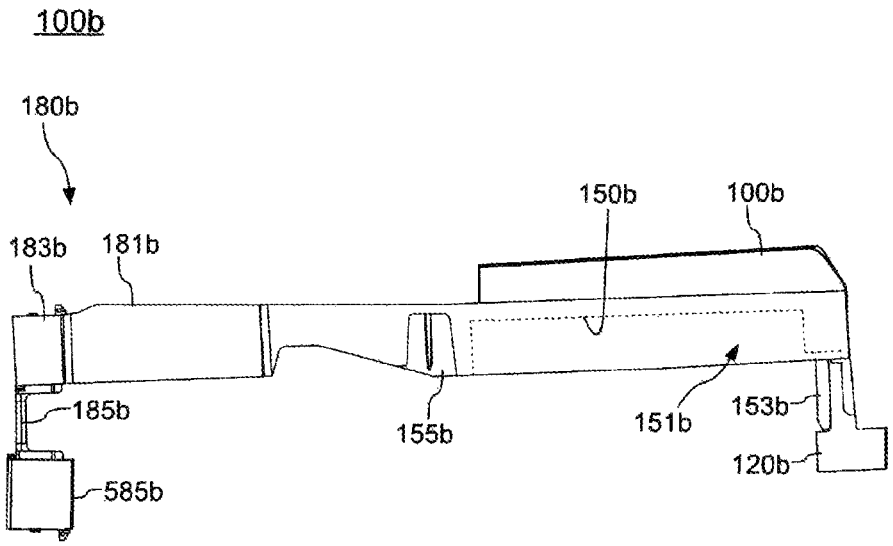
FIG. 5A shows side views illustrating a detailed structure of a black key and a white key in an embodiment of the present invention.
Figure 5B:
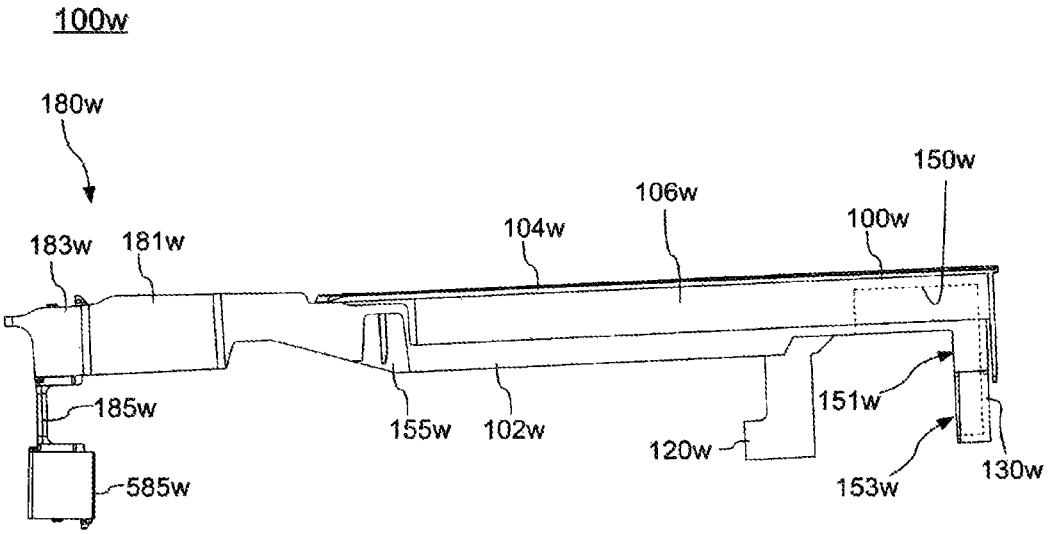
FIG. 5B shows side views illustrating a detailed structure of a black key and a white key in an embodiment of the present invention.

FIGS. 5A and 5B shows side views illustrating a detailed structure of keys in an embodiment of the present invention. FIG. 5A shows a black key 100*b* as viewed from the side, and FIG. 5B shows a white key 100*w* as viewed from the side. As shown in FIG. 5A, the black key 100*b* is connected to the frame side support portion 585*b* via the connecting portion 180*b*. Similarly, as shown in FIG. 5B, the white key 100*w* is connected to the frame side support portion 585*w* via the connecting portion 180*w*. Note that, in the following description, a reference numeral that is not followed by "b" or "w" is used when describing a member that has a feature shared by the black key 100*b* and the white key 100*w*. For example, if the connecting portion 180*b* of the black key 100*b* and the connecting portion 180*w* of the white key 100*w* have similar features, these connecting portions are simply called the connecting portion 180 of a key 100 without distinction.

The black key 100*b* is provided with the first key guide 151*b*, the second key guide 153*b*, and the side face key guide 155*b*. The first key guide 151*b* is provided above the second key guide 153*b*. Although, in FIG. 5A, each of the first key guide 151*b*, the second key guide 153*b*, and the side face key guide 155*b* is formed integrally, each of these key guides may alternatively be formed as separate members and adhered or fixed to the black key 100*b*.

The first key guide 151*b* of the black key 100*b* is provided at the key front end side of the black key 100*b* within a recessed portion 150*b*, which is open downward, of the black key 100*b*. The first key guide 151*b* and the first frame guide 511*b* slide with respect to each other, with the first frame guide 511*b* shown in FIG. 3 inserted into the recessed portion 150*b*. That is, the first key guide 151*b* is a portion of an inner wall of the recessed portion 150*b*.

The second key guide 153*b* of the black key 100*b* extends downward of the black key 100*b* at the front end of the black key 100*b*. The second key guide 153*b* is a plate-like portion that is elongated in the vertical direction. The upper end of the second key guide 153*b* is inserted into the inside of the recessed portion 150*b*, and is connected to both side walls of the recessed portion 150*b* in the scale direction. This structure increases the mechanical strength of the second key guide 153*b* in the scale direction. The second key guide 153*b* and the second frame guide 513*b* slide with respect to each other, with the second key guide 153*b* sandwiched by the second frame guide 513*b*. Note that the hammer support portion 120*b* is connected to a lower portion of the second key guide 153*b*.

The white key 100*w* is provided with the first key guide 151*w*, the second key guide 153*w*, and the side face key guide 155*w*. The first key guide 151*w* is provided above the second key guide 153*w*. The white key 100*w* has a first resin portion 102*w*, a second resin portion 104*w*, and a wooden portion 106*w*. The wooden portion 106*w* is provided between the first resin portion 102*w* and the second resin portion 104*w*. The first resin portion 102*w* and the second resin portion 104*w* are connected to each other on the rear end side of the white key 100*w*. The second resin portion 104*w* is connected to the upper face and the key front end side of the wooden portion 106*w*. The first key guide 151*w*, the second key guide 153*w*, and the side face key guide 155*w* are provided in the first resin portion 102*w*. The second resin portion 104*w* is an area in which the player touches the key. Although, in FIG. 5B, each of the first key guide 151*w*, the second key guide 153*w*, and the side face key guide 155*w* is formed integrally, each of these key guides may alternatively be formed as separate members and adhered or fixed to the white key 100*w*.

The first key guide 151*w* of the white key 100*w* is provided within a recessed portion 150*w* on the key front end side of the white key 100*w*. The recessed portion 150*w* is provided in a lower portion of the white key 100*w*, on the key rear end side of an extension portion 130*w*, which extends downward from the white key 100*w*. The first key guide 151*w* and the first frame guide 511*w* slide with respect to each other, and the second key guide 153*w* and the second frame guide 513*w* slide with respect to each other, with the first frame guide 511*w* and the second frame guide 513*w* shown in FIG. 4 inserted into the recessed portion 150*w* of the white key 100*w*. As described above, both the first key guide 151*w* and the second key guide 153*w* are portions of the inner wall of the recessed portion 150*w*, but a portion that slides with respect to the later-described first frame guide 511*w* is referred to as the first key guide 151*w*, and a portion that slides with respect to the second frame guide 513*w* is referred to as the second key guide 153*w*.

In the above configuration, a key fulcrum (the rod-like flexible member 185*b*), the first guide 51*b*, and the second guide 53*b* of the black key 100*b* restrict movement of the black key 100*b* at three positions that are not arranged in the same line when the black key 100*b* is viewed in the scale direction. That is, since the first guide 51*b* is arranged above the second guide 53*b* as shown in FIG. 3, the key fulcrum, the first guide 51*b*, and the second guide 53*b* are not located on the same line when viewed in the scale direction. More specifically, as shown in FIG. 3, the second guide 53*b* is not located on a line L1 that substantially connects the key fulcrum to the first guide 51*b*, and the first guide 51*b* is not located on a line L2 that substantially connects the key fulcrum to the second guide 53*b*. Similarly, the key fulcrum (the rod-like flexible member 185*w*), the first guide 51*w*, and the second guide 53*w* of the white key 100*w* restrict movement of the white key 100*w* at three positions that are not arranged in the same line when the white key 100*w* is viewed in the scale direction. That is, since the first guide 51*w* is arranged above the second guide 53*w* as shown in FIG. 4, the key fulcrum, the first guide 51*w*, and the second guide 53*w* are not located on the same line when viewed in the scale direction. More specifically, as shown in FIG. 4, the second guide 53*w* is not located on a line L3 that substantially connects the key fulcrum to the first guide 51*w*, and the first guide 51*w* is not located on a line L4 that substantially connects the key fulcrum to the second guide 53*w*.

Since members described below are those with features shared by the black key 100*b* and the white key 100*w*, these members will be described without distinguishing between the black key 100*b* and the white key 100*w*.

The side face key guide 155 is provided at a position that corresponds to the non-visible area NV of a key 100. The side face key guide 155 has a plate-like shape formed by a side face of a portion of the key 100 in the longitudinal direction thereof being recessed in the scale direction. The side face key guide 155 and the side face frame guide 515 slide with respect to each other, with the side face key guide 155 sandwiched by the side face frame guide 515.

The plate-like flexible member 181 is a plate-like member that is flexible in the yawing direction. The plate-like flexible member 181 is arranged such that the normal direction of the plate surface thereof is oriented in the scale direction. Thus, the plate-like flexible member 181 can be deformed in the rolling direction and the yawing direction by being bent or twisted. That is, due to its flexibility, the plate-like flexible member 181 has degrees of freedom in the rolling direction and the yawing direction of the key 100. It can also be said that the plate-like flexible member 181 also has a degree of freedom in the scale direction by combining deformations in the yawing direction. On the other hand, the plate-like flexible member 181 is not substantially deformed in the vertical direction. Note that the normal direction of the plate-like flexible member 181 does not need to completely coincide with the scale direction, and need only have a component in the scale direction. In the case where the normal direction of the plate-like flexible member 181 does not coincide with the scale direction, it is preferable that the angle formed by the normal direction and the scale direction is as small as possible.

The rod-like flexible member 185 is a flexible rod-like member. The rod-like flexible member 185 includes the rotation center (key fulcrum) of the key 100 when the key is pressed. The rod-like flexible member 185 can be deformed in the rolling direction and the yawing direction by being bent or twisted. That is, due to its flexibility, the rod-like flexible member 185 has degrees of freedom in the rolling direction and the yawing direction of the key 100. It can also be said that the rod-like flexible member 185 also has a degree of freedom in the scale direction by combining deformations in the rolling direction. On the other hand, the rod-like flexible member 185 is not substantially deformed in the vertical direction. Note that, due to the characteristic of the shape, the amount by which the rod-like flexible member 185 can twist is greater than that of the plate-like flexible member 181.

The cross-sectional shape of the rod-like flexible member 185 (the cross-section thereof perpendicular to the longitudinal direction of the rod-like shape) is a shape enclosed by a combination of a curved line and a straight line, and is a semi-circular shape in this example. In the circular shape, the straight line portion is located on the rear side and the curved line is located on the front side, but the circular shape may be oriented in the opposite direction. Note that the cross-sectional shape of the rod-like flexible member 185 may alternatively be a shape enclosed only by curved lines (e.g. a circular shape), or may be a shape enclosed only by straight lines (e.g. a rectangular shape). That is, the cross-sectional shape of the rod-like flexible member 185 may be any shape as long as the rod-like flexible member 185 can be bent and deformed in directions other than the longitudinal direction (vertical direction) of the rod-like flexible member 185 (i.e. two out of three directions that define three dimensions), and can be twisted and deformed around the longitudinal direction thereof. The rod-like flexible member 185 may have a shape, such as a conical shape, whose thickness varies in the longitudinal direction.

Structure of Frame

Figure 6:
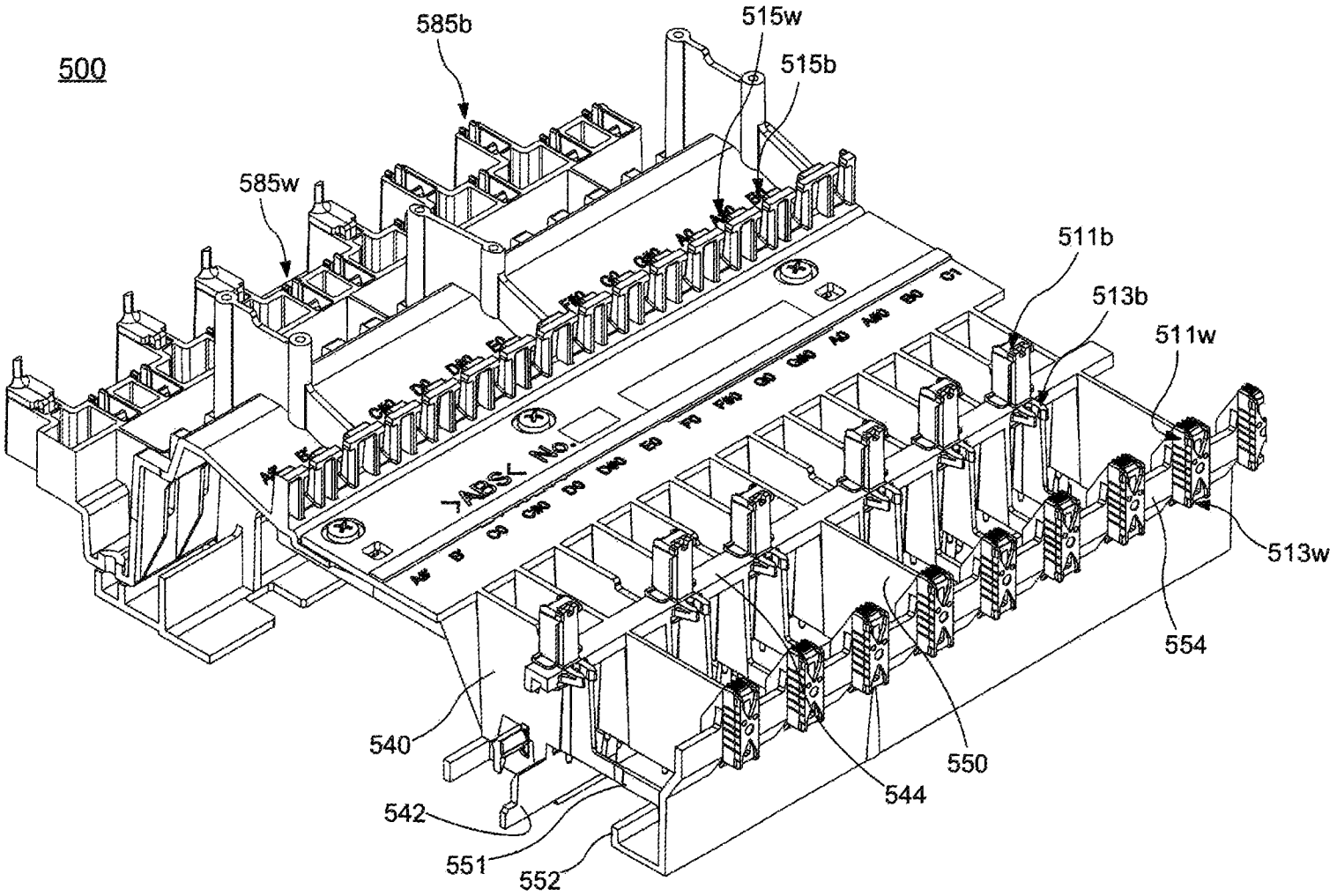
FIG. 6 is a perspective view illustrating a detailed structure of a frame in an embodiment of the present invention.

FIG. 6 is a perspective view illustrating a detailed structure of the frame in an embodiment of the present invention. The frame 500 includes the first frame guide 511*b*, the second frame guide 513*b*, and the side face frame guide 515*b* for black keys 100*b*, as well as the first frame guide 511*w*, the second frame guide 513*w*, and the side face frame guide 515*w* for white keys 100*w*. The frame 500 also includes first ribs 540, a first wall portion 542, a column 544, second ribs 550, third ribs 551, a second wall portion 552, and a third wall portion 554. Note that both the aforementioned "ribs" and "wall portions" are plate-like members, but a "rib" is a plate-like member that extends in a direction parallel to the longitudinal direction of the keys 100, and a "wall portion" is a plate-like member that extends in a direction perpendicular to the longitudinal direction of the keys 100.

The first frame guide 511*b* and the second frame guide 513*b* are arranged corresponding to each of the black key 100*b* in the visible area PV. A plurality of first frame guides 511*b* and a plurality of second frame guides 513*b* are connected by the column 544. Each first frame guide 511*b* protrudes upward from the column 544. Each second frame guide 513*b* protrudes toward the key front end side from the column 544. The first frame guide 511*b* and the second frame guide 513*b* are provided at positions different in the vertical direction, and restrict operation of the corresponding black key 100*b* at their respective positions.

The first frame guide 511*w* and the second frame guide 513*w* are arranged corresponding to each of the white keys 100*w* in the visible area PV. A plurality of first frame guides 511*w* and a plurality of second frame guides 513*w* are connected by the third wall portion 554. Each first frame guide 511*w* and the corresponding second frame guide 513*w* are constituted by the same member, but slide with respect to the corresponding white key 100*w* at positions different in the vertical direction. A portion that slides with the white key 100*w* on the relatively upper side is referred to as the first frame guide 511*w*, and a portion that slides with respect to the white key 100*w* on the relatively lower side is referred to as the second frame guide 513*w*. The first frame guide 511*w* and the second frame guide 513*w* are provided at positions different in the vertical direction, and restrict operation of the white key 100*w* at their respective positions. Note that the first frame guide 511*w*; and the second frame guide 513*w* may alternatively be constituted by different members.

The side face frame guide 515 is arranged between adjacent keys 100. The side face frame guide 515 is in contact with both a white key 100*w* and a black 100*b* at a position at which the white key 100*w* and the black key 100*b* are adjacent to each other (for example, between A and B). The side face frame guide 515 is in contact only with white keys 100*w* at a position at which the white keys 100*w* are adjacent to each other (for example, between B and C). A guide that is in contact with a black key 100*b* is referred to as the side face frame guide 515*b*, and a guide that is in contact with a white key 100*w* is referred to as the side face frame guide 515*w*. Due to the side face frame guide 515 being arranged between adjacent keys 100, the adjacent keys 100 can be kept from coming into contact with each other even if the keys 100 move in the scale direction in the non-visible area NV.

The first rib 540 is provided between hammer assemblies 200 that are adjacent to each other. In other words, the hammer assemblies 200 are arranged in spaces partitioned by the first ribs 540. A plurality of first ribs 540 are connected by the column 544 and the first wall portion 542. The second wall portion 552 is provided at a position opposing the first wall portion 542. The second wall portion 552 is connected to the third wall portion 554. The first wall portion 542 and the second wall portion 552 are connected by the second ribs 550 and the third ribs 551. Each second rib 550 has a greater area of a plate-like portion than that of each third rib 551, and is more rigid. A circuit board on which the sensors 300 are formed (see FIGS. 3 and 4) is arranged between the first wall portion 542 and the second wall portion 552.

Frame Guide for Black Key 100*b*

Figure 7:
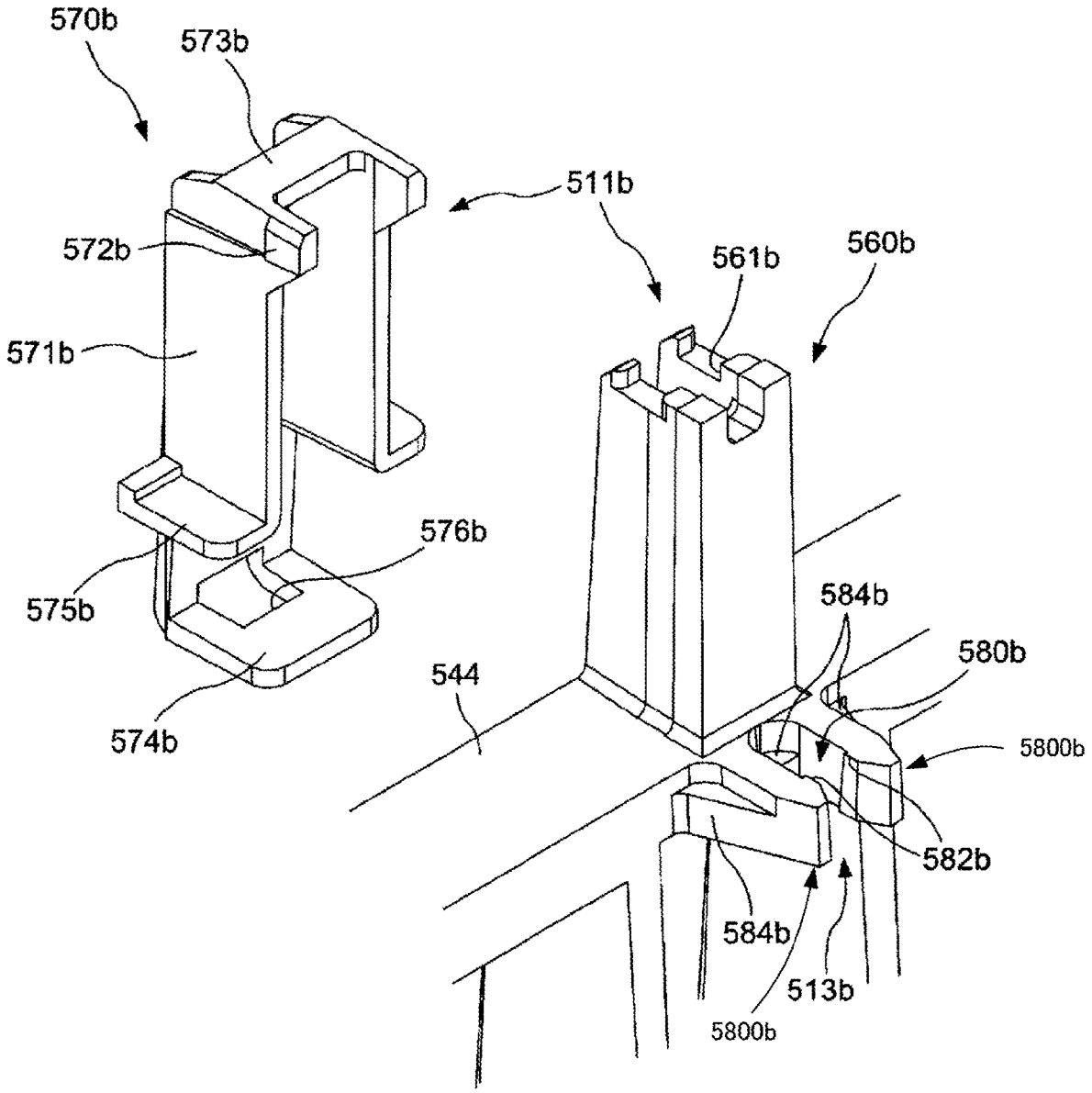
FIG. 7 is an enlarged perspective view of a first guide and a second guide for a black key in an embodiment of the present invention.

A detailed configuration of the first frame guide 511*b* and the second frame guide 513*b* will be described with reference to FIG. 7. FIG. 7 is an enlarged perspective view of the first guide and the second guide for a black key in an embodiment of the present invention.

The first frame guide 511*b* has a protruding portion 560*b* and a sliding member 570*b*. Although FIG. 7 shows a state where the sliding member 570*b* is detached from the protruding portion 560*b* for convenience of description, the sliding member 570*b* is attached to the protruding portion 560*b* as shown in FIG. 6.

The protruding portion 560*b* protrudes upward from the column 544. That is, the protruding portion 560*b* is elongated in the operating direction of the black key 100*b*. A recessed portion 561*b* is provided at the upper end of the protruding portion 560*b*. Although FIG. 7 shows the protruding portion 560*b* formed as a single body with the column 544, the protruding portion 560*b* and the column 544 may alternatively be formed separately and adhered to each other.

The sliding member 570*b* has a main body 571*b*, a pair of protrusions 572*b*, a first stopper 573*b*, a second stopper 574*b*, and a pair of buffer portions 575*b*. The sliding member 570*b* is flexible. The sliding member 570*b* is attached to the protruding portion 560*b* utilizing its flexibility. The sliding member 570*b* may be a member that is softer than a black key 100*b* or the frame 500. The sliding member 570*b* may be, for example, a buffer material such as an elastic body or non-woven fabric. The elastic body may be, for example, a rubber such as nitrile-butadiene rubber (NBR) or ethylene-propylene-diene rubber (EPDM), or may be an elastomer.

The main body 571*b* extends along the protruding portion 560*b*. That is, the main body 571*b* is elongated in the operating direction of the black key 100*b*. The protrusions 572*b* are provided near the upper end of the main body 571*b*. The protrusions 572*b* slide with respect to the first key guide 151*b*. The protrusions 572*b* are provided at respective end portions of the main body 571*b* in the scale direction. The protrusions 572*b* protrude respectively outward of the main body 571*b* in the scale direction. In other words, the protrusions 572*b* protrude outward of the main body 571*b* in the direction in which the column 544 extends. Note that the position and the number of protrusions are not particularly limited.

The first stopper 573*b* is provided at the upper end of the main body 571*b*. In a state where the sliding member 570*b* is attached to the protruding portion 560*b*, the first stopper

573*b* is arranged in the recessed portion 561*b* of the protruding portion 560*b*. The first stopper 573*b* keeps the sliding member 570*b* from withdrawing from the protruding portion 560*b* by being locked to side walls of the recessed portion 561*b*. The second stopper 574*b* is provided at the lower end of the main body 571*b*. In a state where the sliding member 570*b* is attached to the protruding portion 560*b*, the second stopper 574*b* is arranged below the column 544. The second stopper 574*b* keeps the sliding member 570*b* from withdrawing from the protruding portion 560*b* by being locked to the lower face of the column 544. An opening 576*b*, which is provided in the second stopper 574*b*, keeps the second stopper 574*b* from withdrawing from the column 544 by being locked to a protrusion (not shown) that is provided in the lower face of the column 544. The buffer portions 575*b* are provided near the lower end of the main body 571*b* and are arranged near the upper face of the column 544. Thus, collision between the black key 100*b* and the column 544 is mitigated when the black key 100*b* is pressed with strong force.

The second frame guide 513*b* is provided with a pair of projecting portions 5800*b* that protrude toward the key front end side from the column 544. A recessed portion 580*b* is formed between these projecting portions 5800*b*. Protruding portions 582*b* are formed in faces of the projecting portions 5800*b* that face each other. That is, the protruding portions 582*b* protrude toward the inside of the recessed portion 580*b*. These protruding portions 582*b* slide with respect to the second key guide 153*b*. Reinforcing members 584*b* are provided in a bottom portion of the recessed portion 580*b* and between the second frame guide 513*b* and the column 544.

Frame Guide for White Key 100*w*

Figure 8:
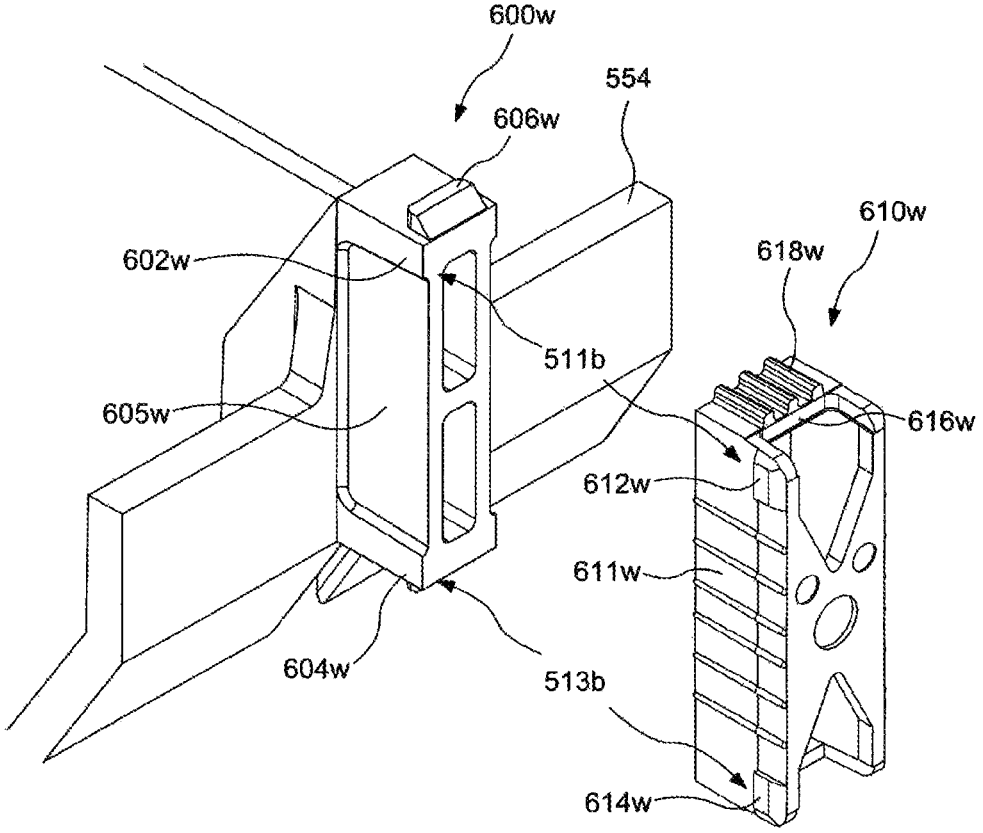
FIG. 8 is an enlarged perspective view of a first guide and a second guide for a white key in an embodiment of the present invention.

A detailed configuration of the first frame guide 511*w* and the second frame guide 513*w* will be described with reference to FIG. 8. FIG. 8 is an enlarged perspective view of the first guide and a second guide for a white key in an embodiment of the present invention.

The first frame guide 511*w* and the second frame guide 513*w* are constituted by a protruding portion 600*w* and a sliding member 610*w*. Although FIG. 8 shows a state where the sliding member 610*w* is detached from the protruding portion 600*w* for convenience of description, the sliding member 610*w* is attached to the protruding portion 600*w* as shown in FIG. 6.

The protruding portion 600*w* protrudes upward and toward the key front end side from the third wall portion 554. That is, the protruding portion 600*w* is enlogated in the operating direction of the white key 100*w*. The protruding portion 600*w* has areas with different thicknesses in the scale direction (or the direction in which the third wall portion 554 extends). Areas with a relatively large thickness in the scale direction are referred to as a first area 602*w* and a second area 604*w*, and an area with a relatively small thickness is referred to as a third area 605*w*. Note that, in the vertical direction (or the operating direction of the key), the third area 605*w* is an area between the first area 602*w* and the second area 604*w*. A protrusion 606*w*, which protrudes upward, is provided at the upper end of the protruding portion 600*w*. A protrusion similar to the protrusion 606*w* is also provided at the lower end of the protruding portion 600*w*. Although FIG. 8 shows the protruding portion 600*w* that is formed as a single body with the third wall portion 554, the protruding portion 600*w* and the third wall portion 554 may alternatively be formed separately and adhered to each other.

The sliding member 610*w* has a main body 611*w*, a pair of first protrusions 612*w*, a pair of second protrusions 614*w*, a stopper 616*w*, and a buffer portion 618*w*. The sliding member 610*w* is flexible. The sliding member 610*w* is attached to the protruding portion 600*w* utilizing its flexibility. The sliding member 610*w* may be a member that is softer than a white key 100*w* or the frame side 500. The sliding member 610*w* may be, for example, a buffer material such as an elastic body or non-woven fabric. The elastic body may be, for example, a rubber such as nitrile-butadiene rubber (NBR) or ethylene-propylene-diene rubber (EPDM), or may be an elastomer.

The main body 611*w* extends along both side faces of the protruding portion 600*w* in the scale direction. That is, the main body 611*w* is elongated in the operating direction of the white key 100*w*. The first protrusions 612*w* are provided near the upper end of the main body 611*w*, and the second protrusions 614*w* are provided near the lower end of the main body 611*w*. The first protrusions 612*w* slide with respect to a corresponding first key guide 151*w*, and the second protruding portions 614*w* slide with respect to a corresponding key guide 153*w*. The first protrusions 612*w* and the second protrusions 614*w* are provided at both end portions of the main body 611*w* in the scale direction. The first protrusions 612*w* and the second protrusions 614*w* protrude outward of the main body 611*w* in the scale direction. In other words, the first protrusions 612*w* and the second protrusions 614*w* protrude outward of the main body 611*w* in the direction in which the third wall portion 554 extends. Note that the position and the number of respective protrusions are not particularly limited.

The stopper 616*w* is provided near the upper end of the main body 611*w*. The stopper 616*w* is locked to the protrusion 606*w* with the sliding member 610*w* attached to the protruding portion 600*w*. This locking keeps the sliding member 610*w* from withdrawing from the protruding portion 600*w*. A stopper similar to the stopper 616*w* is also provided at the lower end of the main body 611*w*, and this stopper is locked to the protrusion provided at the lower end of the protruding portion 600*w*. The buffer portion 618*w* is provided on the upper face of the stopper 616*w*, and mitigates collision between the white key 100*w* and the protruding portion 600*w* when the white key 100*w* is pressed with strong force. Although, in this embodiment, the buffer portion 618*w* is formed with a plurality of ribs, the number and shape of ribs may be other than those in this embodiment.

Description of First Guide 51*b* and Second Guide 53*b*

Figure 9:
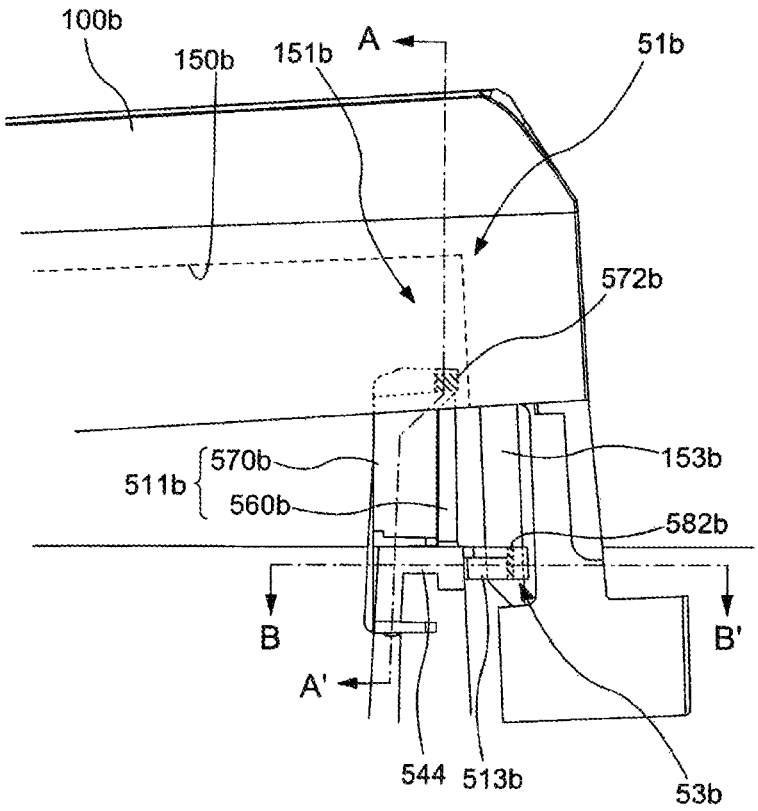
FIG. 9 is an enlarged side view of a first guide and a second guide for a black key in an embodiment of the present invention.
Figure 10:
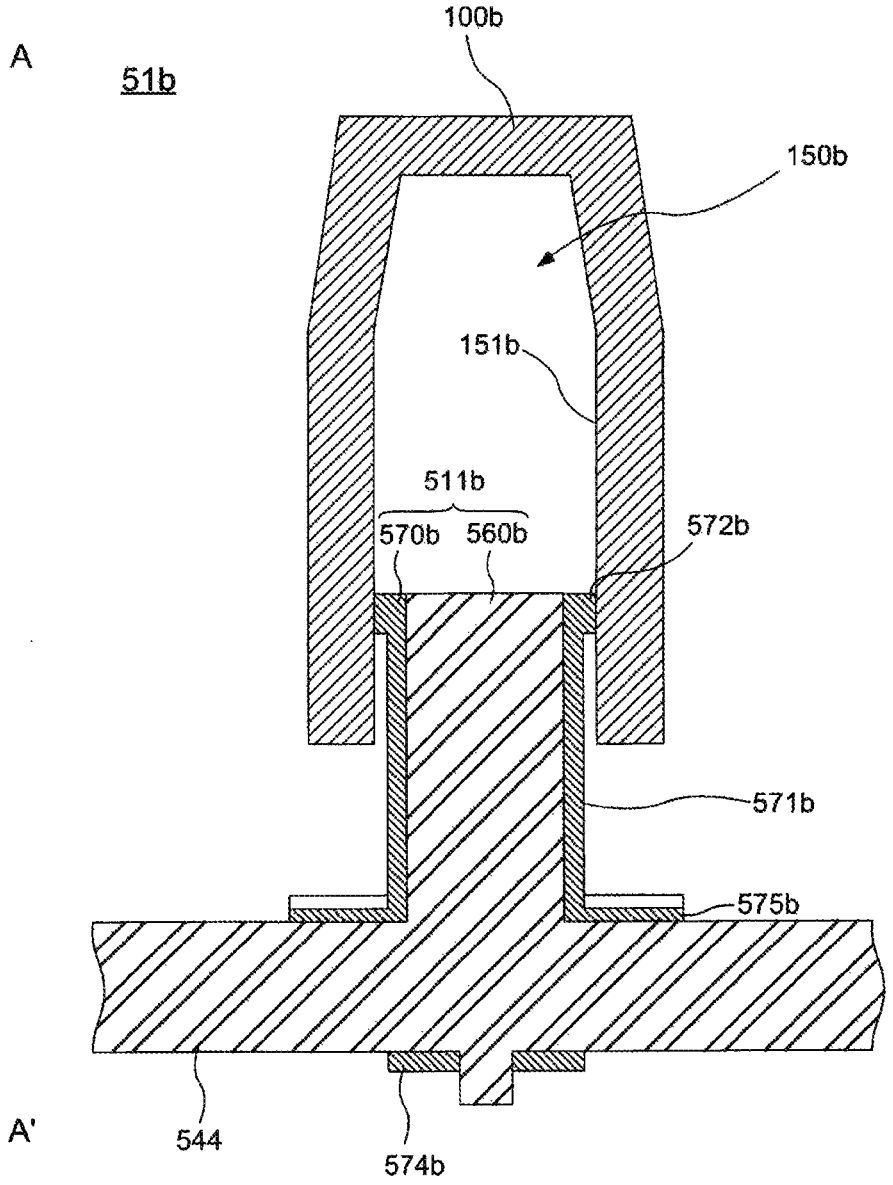
FIG. 10 is a cross-sectional view of the first guide in an embodiment of the present invention, taken along a line A-A'.
Figure 11:
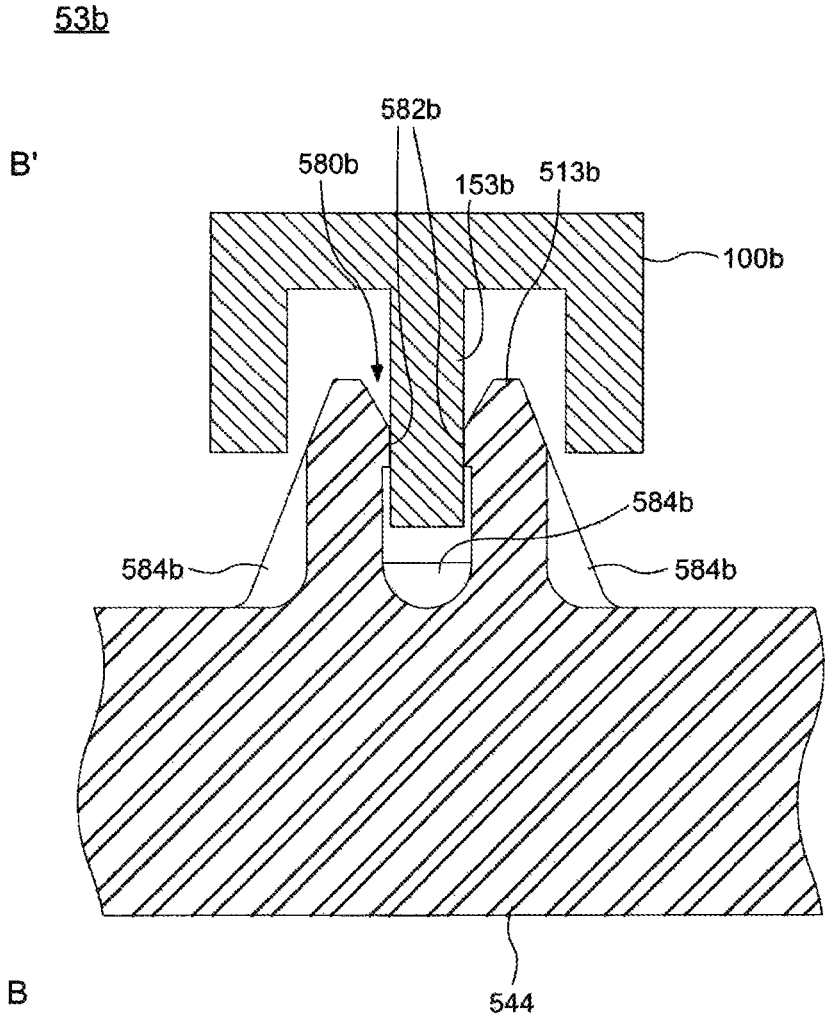
FIG. 11 is a cross-sectional view of the second guide in an embodiment of the present invention, taken along a line B-B'.

The first guide 51*b* and the second guide 53*b* will be described with reference to FIGS. 9 to 11. FIG. 9 is an enlarged side view of the first guide 51*b* and the second guide 53*b* for a black key in an embodiment of the present invention. FIG. 10 is a cross-sectional view of the first guide in an embodiment of the present invention, taken along a line A-A'. FIG. 11 is a cross-sectional view of the second guide in an embodiment of the present invention, taken along a line B-B'.

In the following description, a state of a guide that brings a black key 100*b* to come into contact with a first member, which is softer than a black key 100*b* and the frame 500, will be referred to as a "first state", and a state of a guide that brings a black key 100*b* to come into contact with a second member, which is harder than the aforementioned first member, will be referred to as a "second state". These definition also applies to a white key 100*w*.

As shown in FIGS. 9 and 10, in the first guide 51*b*, the first frame guide 511*b* is inserted into the inside of the first key guide 151*b*. In other words, the protruding portion 560*b* and the sliding member 570*b* are inserted into the inside of the recessed portion 150*b* of the black key 100*b*. Operation of the black key 100*b* is restricted due to the protrusions 572*b* (hatched portion in FIG. 9) of the sliding member 570*b* sliding with respect to the inner wall of the recessed portion 150*b*. That is, in the first guide 51*b*, the black key 100*b* comes into contact with the sliding member 570*b* that is softer than both a black key 100*b* and the frame 500. That is, the state of the first guide 51*b* at this time is the first state.

As shown in FIGS. 9 and 11, in the second guide 53*b*, the second key guide 153*b* is sandwiched by the second frame guide 513*b*. In other words, the second key guide 153*b* is sandwiched by the protruding portions 582*b*. The operation of the black key 100*b* is restricted due to the second key guide 153*b* sliding with respect to the protruding portions 582*b*. That is, in the second guide 53*b*, the black key 100*b* comes into contact with a portion of the frame 500, which is harder than the sliding member 570*b*. That is, the state of the second guide 53*b* at this time is the second state.

As described above, in the first guide 51*b*, the sliding member 570*b* for the black key 100*b* is attached to a portion of the frame 500, and, in the second guide 53*b*, the black key 100*b* comes into contact with a portion of the frame. In other words, the member of the first guide 51*b* to which the sliding member 570*b*, which comes into contact with the black key 100*b*, is attached is the same as the member of the second guide 53*b* with which the black key 100*b* comes into contact. However, the present invention is not limited to the above configuration. These members may be different members.

To describe the above configuration in other words, of the plurality of guides for a black key 100*b*, the upper guide (the first guide 51*b*) is in the first state, and the lower guide (the second guide 53*b*) is in the second state. However, the present invention is not limited to the above configuration. The number of guides for a black key 100*b* in the second state need only be greater than the number of guides for a white key 100*w* in the second state. For example, the upper guide and the lower guide may be in the second state and the first state, respectively. Alternatively, the upper and lower guides may be in the second state.

Figure 12:
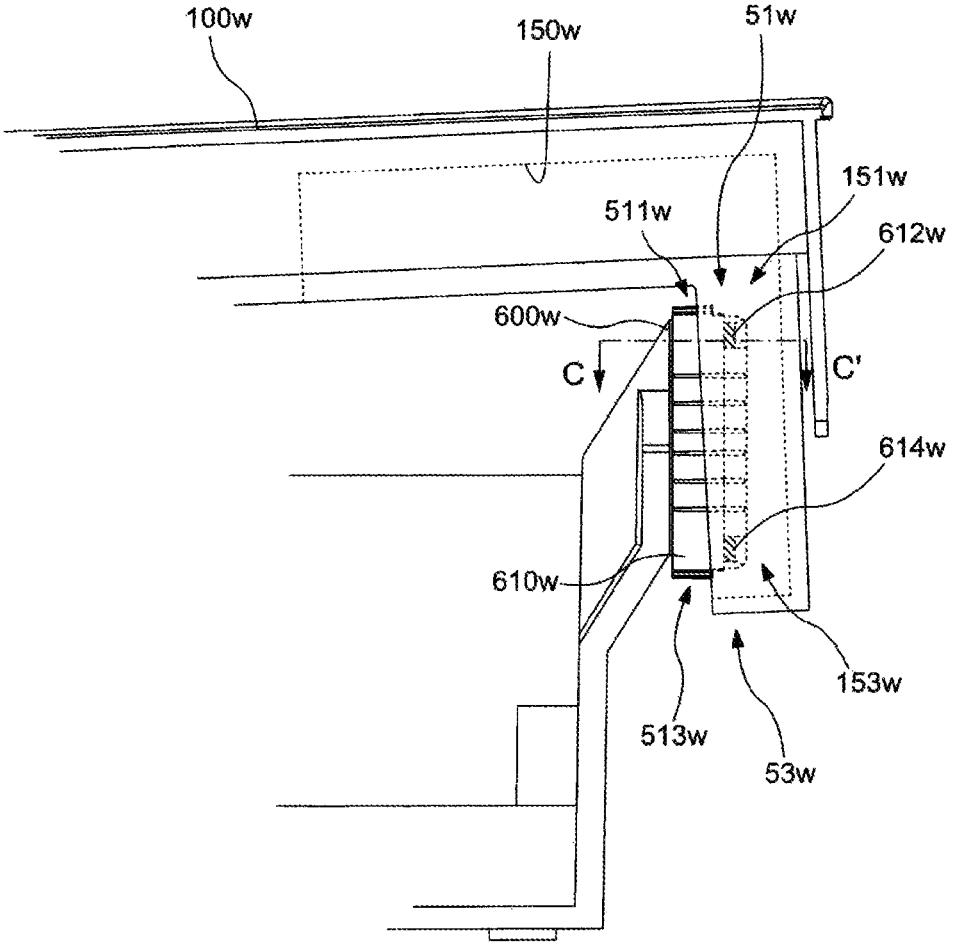
FIG. 12 is an enlarged side view of the first guide and the second guide for a white key in an embodiment of the present invention.
Figure 13:
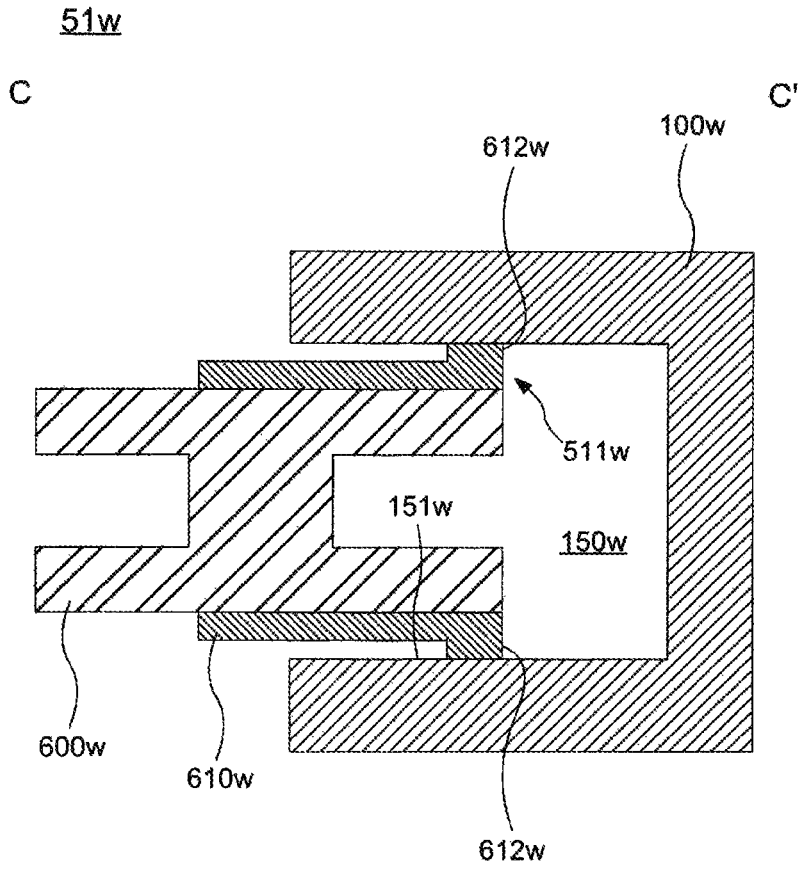
FIG. 13 is a cross-sectional view of the first guide in an embodiment of the present invention, taken along a line C-C'.

The first guide 51*w* and the second guide 53*w* will be described with reference to FIGS. 12 and 13. FIG. 12 is an enlarged side view of the first guide 51*w* and the second guide for a white key in an embodiment of the present invention. FIG. 13 is a cross-sectional view of the first guide in an embodiment of the present invention, taken along a line C-C'. Note that the first guide 51*w* and the second guide 53*w* have substantially the same cross-sectional shape, and accordingly, only the cross-sectional shape of the first guide 51*w* is shown.

As shown in FIGS. 12 and 13, in the first guide 51*w* and the second guide 53*w*, the first frame guide 511*w* is inserted into the inside of the first key guide 151*w*, and the second frame guide 513*w* is inserted into the inside of the second key guide 153*w*. In other words, the protruding portion 600*w* and the sliding member 610*w* are inserted into the recessed portion 150*w* of the white key 100*w*. The operation of the white key 100*w* is restricted due to the first protrusions 612*w* and the second protrusions 614*w* (hatched portions in FIG. 12) of the sliding member 610*w* sliding with respect to the inner wall of the recessed portion 150*w*. That is, in the first guide 51*w* and the second guide 53*w*, the white key 100*w* comes into contact with the sliding member 610*w*, which is softer than both a white key 100*w* and the frame 500. That is, the first guide 51*w* and the second guide 53*w* at this time are in the first state.

As described above, in the first guide 51*w* and the second guide 53*w*, the sliding member 610*w* for the white key 100*w* is attached to a portion of the frame 500, and, in the first guide 51*w* and the second guide 53*w*, the white key 100*w* comes into contact with the sliding member 610*w*. In other words, the member of the first guide 51*w* to which the sliding member 610*w* that comes into contact with the white key 100*w* and is attached is the same as the member of the second guide 53*w* with which the white key 100*w* comes into contact. However, the present invention is not limited to the above configuration. These members may be different members.

To describe the above configuration in other words, of the plurality of guides for a white key 100*w*, the upper and lower guides (the first guide 51*w* and the second guide 53*w*) are in the first state. However, the present invention is not limited to the above configuration. The number of guides for a black key 100*b* in the second state need only be greater than the number of guides for a white key 100*w* in the second state. For example, the upper guide and the lower guide may be in the second state and the first state, respectively. Conversely, the upper guide and the lower guide may be in the first state and the second state, respectively.

As described above, in a black key 100*b*, the first guide 51*b* is in the first state, and the second guide 53*b* is in the second state. Meanwhile, in a white key 100*w*, both the first guide 51*w* and the second guide 53*w* are in the first state. That is, all of the guides for the white key 100*w* are in the first state. Accordingly, the number of guides for a black key 100*b* in the second state is greater than the number of guides for a white key 100*w* in the second state. Note that "greater" includes the case where the number of guides for either one of the white and black keys in the second state is zero, and the number of guides for the other key is one or more. Although the above example describes a configuration in which the number of guides for a black key 100*b* and the number of guides for a white key 100*w* is two, the present invention is not limited to this configuration.

For example, each of the number of guides for a black key 100*b* and the number of guides for a white key 100*w* may be three or more. The number of guides for a black key 100*b* may differ from the number of guides for a white key 100*w*. In these cases as well, the number of guides for a black key 100*b* in the second state is greater than the number of guides for a white key 100*w* in the second state. Note that all of the guides for a black key 100*b* may be in the second state. All of the guides for a white key 100*w* may be in the first state.

The above embodiment has described an example of a configuration in which, in the second state, a key 100 comes into contact with a portion of the frame 500, but the present invention is not limited to this configuration. The member with which a key 100 comes into contact in the second state need only be harder than the member with which the key 100 comes into contact in the first state. In the second state, another member may also be placed between a key 100 and a portion of the frame 500.

The above configuration has described an example of a configuration in which the number of guides for a black key 100*b* in the second state is greater than the number of guides for a white key 100*w* in the second state, but the present invention is not limited to this configuration. For example, conversely, the number of guides for a white key 100*w* in the second state may be greater than the number of guides for a black key 100*b* in the second guide. The number of guides in the second state may differ between white keys 100*w* or black keys 100*b* with different pitches.

As described above, according to the keyboard device 1 according to Embodiment 1 of the present invention, the number of guides in the first state differs from the number of guides in the second state depending on the keys 100, and the touch of each key 100 for the player can thus be freely adjusted.

Note that, as for the number of guides, for example, the number of protrusions or protruding portions provided on the left and right to form a pair and are arranged in the scale direction, such as the protrusions and the protruding portions in the present embodiment, is considered to be one. Accordingly, in the example of the present embodiment, of the guides for a black key 100*b*, the pair of protrusions 572*b* constitutes the first state, and the pair of protruding portions 582*b* constitutes the second state. Also, of the guides for a white key 100*w*, the pair of protrusions 612*w* constitutes the first state, and the pair of protrusions 614*w* constitutes the first state.

Since the black keys 100*b* protrude outward, the rigidity thereof in the rolling direction felt by the player is likely to deteriorate, compared with the white keys 100*w*, due to the sliding member 570*b* being attached. Accordingly, as a result of the number of guides that keep each black key 100*b* in the second state being greater than the number of guides that keep each white key 100*w* in the second state, as in Embodiment 1, the rigidity of the black keys 100*b* in the rolling direction felt by the player can be approximated to that of the white keys 100*w*.

Mechanical noise generated above the keys that are likely to be affected by key operations of the player can be suppressed by causing the upper guides (the first guides 51*b* and 51*w*) for the black keys 100*b* and the white keys 100*w* to enter the first state, that is, as a result of the sliding member 570*b* being provided between each black key 100*b* and the frame 500 and the sliding member 610*w* being provided between each white key 100*w* and the frame 500, in the guides on the side closer to the player.

Second Embodiment

The second embodiment will describe a keyboard device 1A that includes a first guide 51A, which has a configuration different from the configuration of the first guide 51 in the first embodiment.

Figure 14:
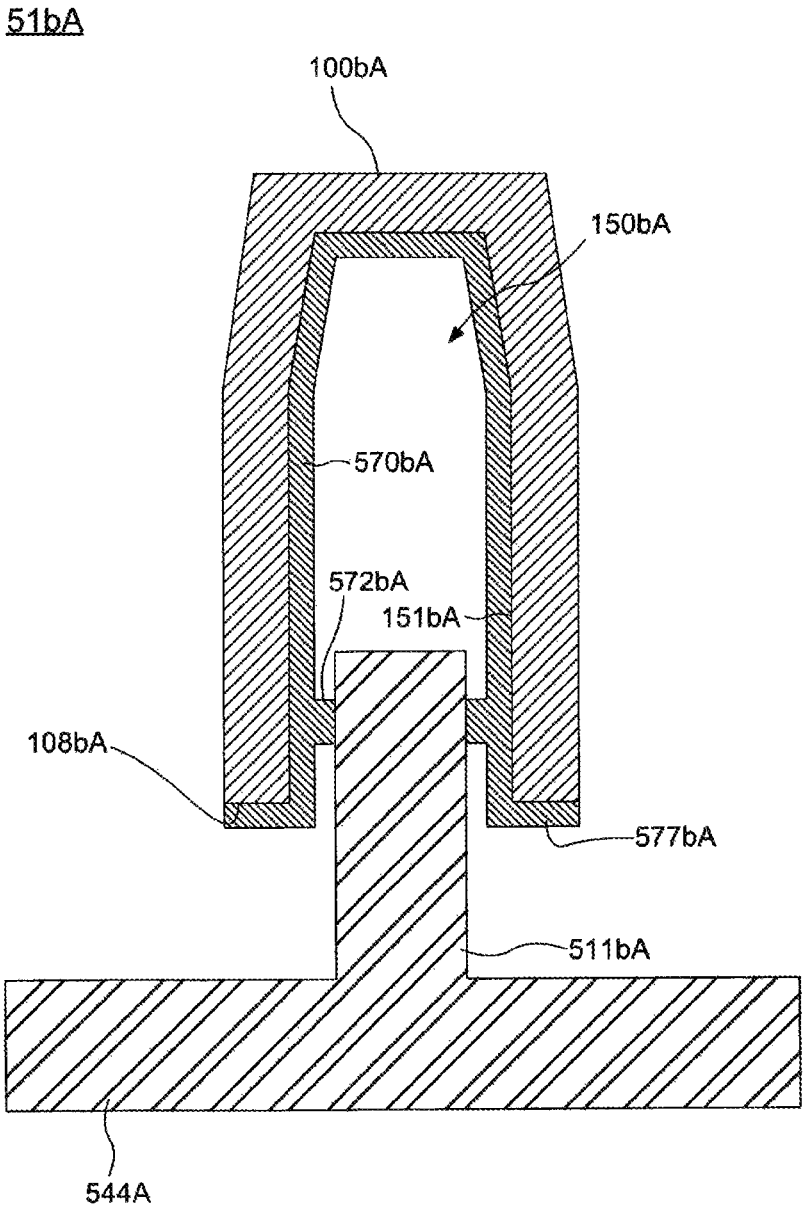
FIG. 14 is a cross-sectional view of the first guide in an embodiment of the present invention, taken along a line A-A'.

FIG. 14 is a cross-sectional view of the first guide in an embodiment of the present invention, taken along a line A-A'. The cross-sectional view in FIG. 14 illustrates a first guide 51*b*A and corresponds to the cross-sectional view in FIG. 10. The first guide 51*b*A in FIG. 14 is similar to the first guide 51*b* in FIG. 10, but differs from the first guide 51*b* in that a sliding member 570*b*A is attached to each black key 100*b*A.

The sliding member 570*b*A is arranged along an inner wall face of a recessed portion 150*b*A, which is provided in a black key 100*b*A. In other words, the sliding member 570*b*A is arranged in the first key guide 151*b*A (or the black key 100*b*A). A pair of protrusions 572*b*A, which are provided in the sliding member 570*b*A, protrude from the first key guide 151*b*A toward a first frame guide 511*b*A. The protrusions 572*b*A slide with respect to the first frame guide 511*b*A. A buffer portion 577*b*A, which is provided in the sliding member 570*b*A, is arranged at a lower end 108*b*A of the black key 100*b*A, and moves together with the black key 100*b*A.

To describe the above configuration in other words, in the first guide 51*b*A, a black key 100*b*A comes into contact with the sliding member 570*b*A, which is softer than both a black key 100*b*A and the frame 500A. That is, the state of the first guide 51*b*A at this time is the first state. Note that the sliding member 610*w* attached to each white key 100*w* can also be attached to the recessed portion 150*w* for the white key 100*w*, as shown in FIG. 14.

As mentioned above, the sliding member 570*b*A may be attached to each black key 100*b*A. In this case as well, effects similar to those of the first embodiment can be achieved.

In the above embodiments, (1) the first guide 51, the second guide 53, and the third guide 55 are not arranged on the same light when each key 100 is viewed in the scale direction, and (2) the key fulcrum (the rod-like flexible member 185), the first guide 51, and the second guide 53 are not arranged on the same line when each key 100 is viewed in the scale direction. The configurations (1) and (2) can enable each key 100 to be restricted from moving in the scale direction, the yawing direction, and the rolling direction. However, either one of the configurations (1) and (2) may be employed to achieve this effect. However, it is more effective to employ both the configurations (1) and (2).

The above embodiments have described an electronic piano as an example of a keyboard device to which the first guide 51 and the second guide 53 are applied. Meanwhile, the first guide 51 and the second guide 53 in the above embodiments can also be applied to an acoustic piano (a grand piano, an upright piano, or the like). In this case, a sound generating mechanism corresponds to a hammer and a string. The rotational mechanism in the above embodiments can also be applied to a rotational component in an instrument other than a piano.

Note that the present invention is not limited to the above embodiments, and may be modified as appropriate without departing from the gist of the invention.

The invention claimed is:

1. A keyboard device comprising:

a frame;

a plurality of keys including a first key and a second key, the plurality of keys rotating around the frame; and a plurality of guides for restricting an operation of each of the plurality of keys, at positions different in a vertical direction, each of the plurality of guides including a first member that is softer than the frame and the plurality of keys, and a second member that is harder than the first member, wherein each of the plurality of guides is in a first state where a corresponding one of the keys comes into contact with the first member, or in a second state where the corresponding one of the keys comes into contact with the second member, and the number of guides restricting the second key in the second state is greater than the number of guides restricting the first key in the second state.

2. The keyboard device according to claim 1, wherein the first key is a white key, and the second key is a black key.

3. The keyboard device according to claim 2, wherein a member to which the first member that comes into contact with the white key is attached and the second member that comes into contact with the white key are the same member.

4. The keyboard device according to claim 2,
wherein a member to which the first member that comes into contact with the black key is attached and the second member that comes into contact with the black key are the same member.

5. The keyboard device according to claim 2,
wherein the first member that comes into contact with the white key is attached to the frame.

6. The keyboard device according to claim 2,
wherein the first member that comes into contact with the black key is attached to the frame.

7. The keyboard device according to claim 2,
wherein the second member that comes into contact with the white key is a portion of the frame.

8. The keyboard device according to claim 2,
wherein the second member that comes into contact with the black key is a portion of the frame.

9. The keyboard device according to claim 2,
wherein the first member that comes into contact with the white key is attached to the white key.

10. The keyboard device according to claim 2,
wherein the first member that comes into contact with the black key is attached to the black key.

11. The keyboard device according to claim 2,
wherein, of the plurality of guides that come into contact with the white key, an upper one of the guides is in the first state.

12. The keyboard device according to 2,
wherein, of the plurality of guides that come into contact with the black key, an upper one of the guides is in the first state.

13. A keyboard device comprising:
a frame;
a plurality of keys including a first key and a second key, the plurality of keys rotating around the frame; and
a plurality of guides arranged between each of the plurality of keys and the frame at positions different in a vertical direction, each of the plurality of guides including a first member that is softer than the frame and the plurality of keys, and a second member that is harder than the first member,
wherein the first member is sandwiched by the frame and a corresponding one of the keys,
the second member is sandwiched by the frame and a corresponding one of the keys,
each of the plurality of guides is in a first state where a corresponding one of the keys comes into contact with the first member, or in a second state where the corresponding one of the keys comes into contact with the second member, and
the number of guides that come into contact with the second key in the second state is greater than the number of guides that come into contact the first key in the second state.

14. A keyboard device comprising:
a frame;
a plurality of keys including a first key and a second key, the plurality of keys rotating around the frame; and
a plurality of guides arranged between each of the plurality of keys and the frame at positions different in a vertical direction, each of the plurality of guides including a first member that is softer than the frame and the plurality of keys,
wherein the first member is sandwiched by the frame and a corresponding one of the keys,
each of the plurality of guides is in a first state where a corresponding one of the keys comes into contact with the first member, or in a second state where the corresponding one of the keys comes into contact with the frame, and
the number of guides that come into contact with the second key in the second state is greater than the number of guides that come into contact the first key in the second state.

15. The keyboard device according to claim 14,
wherein the first key is a white key,
the second key is a black key,
guides for the black key include at least one first member, and
guides for the white key include at least one first member.

* * * * *